United States Patent [19]

Smith

[11] Patent Number: 4,712,380

[45] Date of Patent: Dec. 15, 1987

[54] UTILIZATION OF THERMAL ENERGY

[75] Inventor: Ian K. Smith, London, England

[73] Assignee: Solmecs Corporation N.V., Curacao, Netherlands Antilles

[21] Appl. No.: 783,224

[22] PCT Filed: Jan. 23, 1985

[86] PCT No.: PCT/EP85/00067

§ 371 Date: Sep. 24, 1985

§ 102(e) Date: Sep. 24, 1985

[87] PCT Pub. No.: WO85/03328

PCT Pub. Date: Aug. 1, 1985

[30] Foreign Application Priority Data

Jan. 25, 1984 [GB] United Kingdom ..... 8401908

[51] Int. Cl.[4] ..... F01K 7/00

[52] U.S. Cl. ..... 60/641.2; 60/715

[58] Field of Search ..... 60/641.2, 641.3, 641.4, 60/641.5, 715

[56] References Cited

U.S. PATENT DOCUMENTS

| | | | |
|---|---|---|---|
| 3,751,673 | 8/1973 | Sprankle | 60/641.2 |
| 3,817,038 | 6/1974 | Paull et al. | 60/641.2 |
| 3,977,818 | 8/1976 | Sprankle | 60/641.2 X |
| 4,063,417 | 12/1977 | Shields | 60/715 |
| 4,201,060 | 5/1980 | Outmans | 60/641.2 |
| 4,555,905 | 12/1985 | Endou | 60/715 |

*Primary Examiner*—Allen M. Ostrager

*Attorney, Agent, or Firm*—Leydig, Voit & Mayer

[57] ABSTRACT

Various heat cycles are disclosed which make use of comparatively low grade heat such as that from hot rock geo-thermal sources, the cycles incorporating either a helical screw expander or a rotary vane expander operating with an organic working fluid and in accordance with the invention, the exhaust from the helical screw expander or rotary vane expander is used in a conventional rankine cycle.

9 Claims, 4 Drawing Figures

UTILIZATION OF THERMAL ENERGY

This invention relates to the utilization of thermal energy.

Over the past ten years considerable research has been carried out with a view to making use of thermal energy available from geological sources. It will be understood that many of these sources provide an inlet temperature/pressure which is too low to ensure satisfactory operation of most conventional power generating machines such as turbines. Moreover, even if these basic parameters are suitable for use in a turbine, the working fluid is frequently contaminated so that deposits are formed with resultant reduced efficiency and actual damage to the turbines.

With a view to overcoming the basic problems of relatively low grade heat, proposals have been put forward, for example in U.S. Pat. No. 3,751,653 and U.K. published Application No. 2114671, in which relatively low grade heat is utilized for the production of power with the aid of one or more helical screw expanders. Such expanders, initially developed by Lysholm, have the advantage that they can tolerate working fluids which are liable to cause deposits, because close tolerances are not critical to successful operation and deposits from the working fluid may even be beneficial. However, the use of geothermal water as proposed in the U.S. specification has the substantial disadvantage that the properties of water and steam necessitate the use of a very large machine in order to produce the required power. The specification of the published United Kingdom application is primarily concerned with the use of such machines, but employing in place of geothermal water a working fluid which has properties more suited to use in relatively small helical screw expanders.

In the cycle proposed in U.K. patent application No. 2114671, the inlet temperature of the working fluid is preferably fairly low, the geothermally-heated water being at a temperature of the order of 100° C. Probably the greatest benefits will arise from use of geothermally heated water at temperatures of the order of 120° C. At higher temperatures the efficiency advantage of the cycle disclosed in the United Kingdom published specification diminishes but is not eliminated because conventional supercritical Rankine cycles become more attractive in the matching of the boiler heating characteristics to the heat source at higher temperatures. Even at quite high temperatures, of the order of 300° C., the advantage remains.

The general objective of the present invention is further to modify the prior proposals with a view to rendering possible more efficient use of geothermal and other low grade sources which enable higher inlet temperatures to be used than in hitherto proposed systems.

According to the present invention there is provided a method of utilizing thermal energy comprising the steps of heating a working fluid by pumping through a hot dry rock or other low grade heat source, supplying the heat from the working fluid to a more volatile, second, working fluid which passes through a trilateral cycle comprising substantially adiabatically pressurizing the said second working fluid, substantially adiabatically expanding the hot pressurized second working fluid by flashing in a helical screw expander or other expansion machine capable of operating effectively with wet working fluid and of progressively drying said fluid during expansion, passing the exhaust second working fluid through a turbine and condensing the second working fluid exhausted from the turbine.

The trilateral cycle referred to has been described and claimed in our co-pending published patent application No. 2114671. An important distinguishing aspect of the present invention as broadly defined is that the working fluid is chosen such that the expansion from saturated liquid to saturated vapour is carried out in a screw expander with or without preflashing and that further expansion of the saturated vapour is then carried out in a turbine of conventional design such as is used in Rankine systems. The second working fluid exhausted from the helical screw expander may be dry or wet and in the latter event drying will be completed at the inlet nozzles of the turbine.

Further according to the present invention there is provided a method of utilizing low grade thermal energy comprising the steps of heating a working fluid by pumping through hot dry rock or other low grade heat source, passing the heat from the fluid directly or indirectly by means of a second, more volatile, fluid, to a helical screw expander, supplying heat rejected by the screw expander to a further, turbine, expander and returning the first working fluid to the hot dry rock source.

Still further according to the present invention, there is provided apparatus for utilising thermal energy comprising means for pumping a working fluid through a hot dry rock or other low grade heat source, means for supplying the heat from the working fluid to a more volatile, second, working fluid, means for substantially adiabatically pressurizing the second working fluid, a helical screw expander capable of operating effectively with wet working fluid and of progressively drying said fluid during expansion, the expander being connected to receive working fluid from the pressurizing means and serving to substantially adiabatically expand the hot pressurized second working fluid by flashing a turbine connected to receive the exhaust of the expander and a condenser for the second working fluid exhausted from the turbine.

Yet further according to the present invention, there is provided apparatus for utilizing low grade thermal energy comprising pump means for passing a working fluid through hot dry rock or other low grade heat source, means for passing the heat from the working fluid directly or indirectly to a second, more volatile, fluid, a helical screw expander connected to receive the heated second fluid, a further, turbine, expander receiving exhaust second fluid from the helical screw expander and means for returning the first working fluid to the hot dry rock source.

Exhaust heat from the turbine may be employed for industrial or district heating.

The invention will now be described, by way of example only, with reference to the accompanying diagrammatic drawings, in which.

Figure 1:
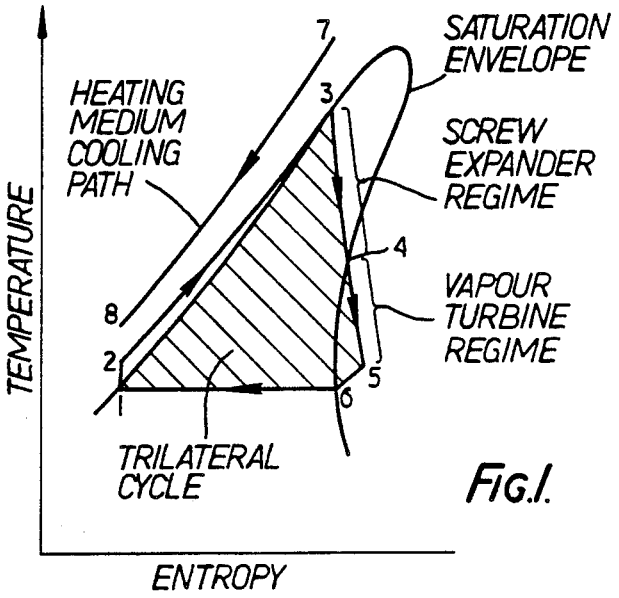
FIG. 1 is a temperature-entropy diagram illustrating a trilateral cycle incorporating two expansion regimes.

Referring now to FIG. 1 the temperature-entropy diagram illustrates the trilateral cycle including the saturation envelope for the working fluid selected (referred to in more detail hereinafter) and the state points 1 to 6 of the working cycle. Substantially adiabatic liquid pressurization takes place 1–2, heating and evaporation 2–3, first stage, substantially adiabatic expansion in a helical screw expander 3–4, second stage, substantially adiabatic expansion in a vapour turbine 4–5, de-superheating 5–6 and condensing 6–1. The heating medium cooling path is shown at 7–8 and follows the heating and evaporation stage 2–3. The heat transfer from the thermal source is effected at approximately constant pressure substantially to the boiling point of the selected working fluid.

Figure 2:
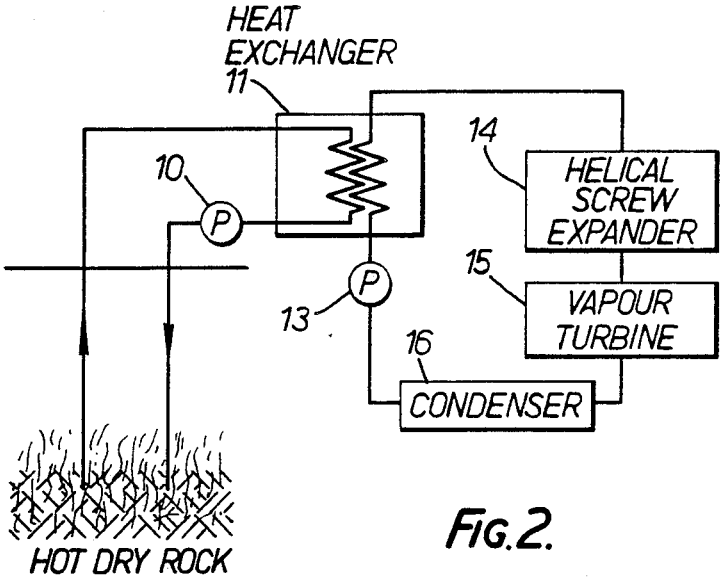
FIG. 2 is a diagram illustrating the main component parts of a plant in accordance with the invention.

FIG. 2 shows highly diagrammatically main components of a plant operating the cycle of FIG. 1. A recirculating pump 10 serves to pump a first working fluid through fragmented hot dry rock and through the hot pass of a heat-exchanger 11. A second, more volatile, working fluid is circulated through the cold pass of heat-exchanger 11 by a feed pump 13 and the boiling, volatile, working fluid then passes through a helical screw expander 14, at the exhaust of which the second working fluid is usually dry and thus suitable for use in a conventional vapour turbine 15. The exhaust from the turbine passes through a condenser 16. The dry saturated state of the second working fluid is achieved by appropriate selection of the fluid itself and the flashing which takes place in the screw expander 14. Pre-flashing, that is, upstream of the inlet to the screw expander is advantageous with certain working fluids and conditions. If the exhaust second working fluid from the screw expander is not fully dry, then the fluid can be dried in nozzles upstream of the first or possibly sole rotor stage.

Figure 3:
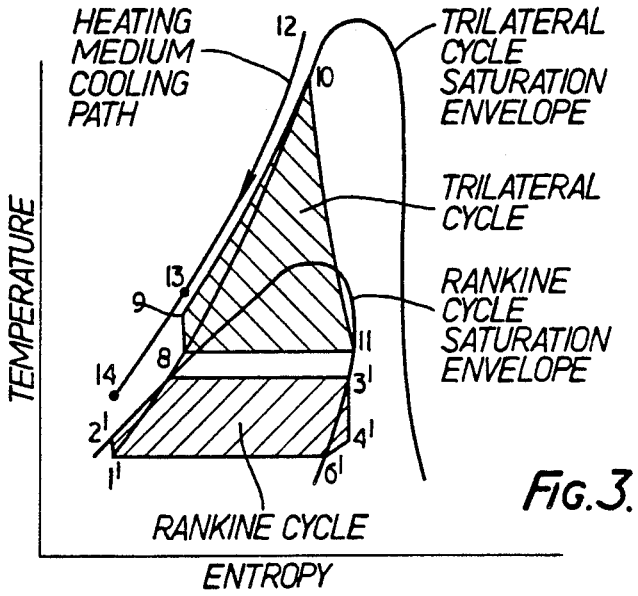
FIG. 3 is a temperature/entropy diagram illustrating a dual cycle in accordance with the present invention.

Referring now to FIG. 3 the temperature entropy diagram illustrates a dual cycle, namely the trilateral cycle fully disclosed in co-pending published U.K. patent application No. 2114671 with a bottoming cycle which is basically the conventional Rankine cycle. The legends shown in the Figure itself provide adequate explanation for the relationship between the two cycles, but for completeness the two cycles will be briefly explained. The sequence of operations indicated in FIG. 3 (equivalent state points of those of FIG. 1 have been retained with the addition of an apostrophe) are: liquid pressurization (1'–2'); heating and evaporation (2'–3'), expansion (3'–4'), de-superheating (4'–6') and condensing (6'–1'). The last two stages are conventionally carried out in a single enlarged condenser. In the trilateral cycle, (which is considered separately from the Rankine cycle) the sequence of operations is: adiabatic pressurization (8–9); heating in the liquid phase only by heat transfer from the thermal source at approximately constant pressure substantially to boiling point (9–10), expansion by phase change from liquid to vapour, substantially adiabatically (10–11) and condensation 15 (11–8).

It should be pointed out that the working fluid of the trilateral cycle can be different to that of the Rankine cycle although some losses will, of course, be incurred in the nencessary heat-exchanger. By the use of the dual cycle the trilateral aspect can be used with much higher critical temperatures without incurring the disadvantages, hereinbefore referred to, resulting from excessive expansion ratios.

Conventional turbines incorporated in Rankine cycles operate most satisfactorily with inlet working fluid which is dry and preferably superheated. The helical screw expander can readily be designed to provide the required working fluid, or the first stage inlet nozzles can complete the drying if required.

With the circuit illustrated in FIG. 2, it is possible to employ hot dry rock as a heat source at temperatures of the order of 250° C. The trilateral-Rankine cycle combination can use a working fluid such as monochlorobenezene ($T_c$=359° C.), THERMEX (Registered Trade Mark) and similar working fluids in which modification the complication of separate condensers and circulating pumps can be avoided. THERMEX is a mixture of diphenyl and diphenyl oxide and has a high critical point. Dichlorobenzene and Toluene are other possible working fluids.

Over a period of many years numerous uses have been proposed for the exhaust heat of a conventional heat engine. Apart from turbo-chargers, however, little practical use has been made of such exhaust heat particularly because the relatively low grade does not facilitate use for power production which is the primary requirement in most instances.

By selection of a suitable working fluid for the trilateral cycle disclosed in our co-pending application No. 2114671 power output can be attained from a helical screw expander with heat at the temperature available from a heat-engine exhaust.

Figure 4:
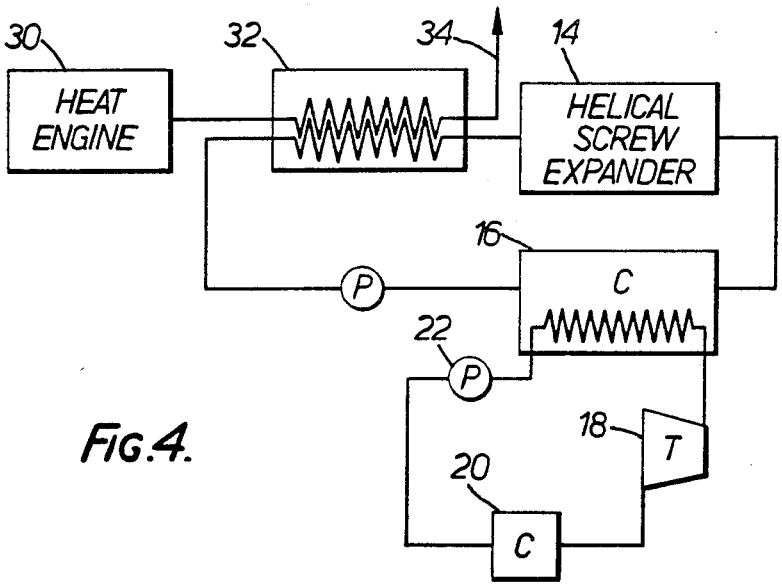
FIG. 4 is a diagram illustrating a modification.

In the circuit illustrated in FIG. 4 where a large heat engine 30 is available such as on board ship, the dual cycle of FIG. 3 can advantageously be employed. The exhaust gases are reduced in temperature from 350° C. to 160° C. in a heat-exchanger 32 and a useful power output can be achieved for example for driving auxiliaries of the ship. The final exhaust 34 can also be used for heating purposes but cooling must not be taken too far. In this embodiment it is possible to obtain good matching between the cooling and heating characteristics of the heat-exchanger 32 and the entire heat rejected in the condenser 16 will serve to drive the Rankine cycle.

Although hot dry rock is the preferred heat source, a high temperature and high pressure geothermal source can also be used. It will, of course, be understood that the helical screw expander and the Rankine cycle turbine will be coupled to a shaft power user such as an electricity generator.

In broad terms the circuits in accordance with the invention are capable of good heat recovery even from a grade of heat which could otherwise be used only for district heating and other applications where no shaft power is required. This advantage is particularly emphasized by the aspects of the invention which combine a trilateral cycle with a conventional Rankine cycle, the latter being able to make use of a useful proportion of the available liquid sensible heat.

In relation to the two embodiments of the invention, helical screw expanders are referred to but it will be appreciated that, in certain instances, rotary vane expanders can be used as an alternative. It follows that wherever reference is made herein to "helical screw expanders" a rotary vane expander can be substituted. Again, for certain aspects of the invention the geo-thermal, hot rock, source can be replaced by an equivalent heat source within a similar temperature range.

A helical screw expander of small size has been tested when making use of an organic fluid and an efficiency of 71% has been attained. With larger sizes such as would be used in practice appreciably higher efficiencies can be expected. This contrasts with efficiencies in the range 55–50% when using two phase, water/steam as the working fluid.

For cycles in accordance with the present invention an overall efficiency of at least 75% will be achieved.

What is claimed is:

1. A method of utilizing thermal energy comprising the steps of heating a first fluid by pumping through a hot dry rock heat source, transferring the heat from the said first fluid to a more volatile, second fluid which passes through a trilateral cycle and recycling the first fluid to the heat source, the said trilateral cycle comprising substantially adiabatically pressurizing the said second fluid, receiving the transferred heat from the first working fluid, substantially adiabatically expanding the hot pressurized second fluid by flashing in a helical screw expander capable of operating effectively with wet working fluid and progressively drying said fluid during expansion, passing substantially the whole of the exhaust dry second fluid through a turbine operating on dry vapor as in the conventional Rankine cycle, condensing the second fluid exhausted from the turbine, and recycling the second fluid to the adiabatic pressurization stage.

2. A method according to claim 1 wherein exhaust second fluid received from the helical screw expander is further dried by passage through inlet nozzles immediately upstream of the first rotor stage of the turbine.

3. A method according to claim 1 wherein the second fluid is monochlorobenzene, dichlobenzene or toluene.

4. Apparatus for utilizing thermal energy comprising means for pumping a first fluid through a hot dry rock heat source, means for transferring the heat from the first fluid to a more volatile, second fluid, pump means for returning the first fluid exhausted from the transfer means to the hot dry rock means for substantially adiabatically pressurizing the said second fluid, a helical screw expander capable of operating effectively with wet working fluid and of progressively drying said fluid during expansion, the expander being connected to receive the second fluid from the pressurizing means after it has been heated by the first fluid and serving substantially adiabatically to expand the hot pressurized second fluid by flashing, a turbine connected to receive substantially the whole of dry exhaust of the expander, a condenser connected to receive substantially the whole of the second fluid exhausted from the turbine and means for recycling the second fluid to the pressurizing means.

5. Apparatus according to claim 4 comprising inlet nozzles immediately upstream of the first rotor stage of the turbine serving further to dry exhaust working fluid received from the helical screw expander.

6. Apparatus according to claim 4 wherein the heat source is, alternatively, a conventional heat engine.

7. Apparatus for utilizing low grade thermal energy comprising pump means for passing a first fluid through hot dry rock, means for delivering heated first fluid from the hot dry rock, means for transferring the heat from the first fluid received from said delivery means to a second, more volatile, fluid, pump means for recycling the first fluid exhausted from the transfer means to the hot dry rock a helical screw expander connected to receive the heated second fluid and expand it until it is at least substantially dry, and a further, turbine, expander connected to receive substantially the whole of the dry exhaust second fluid from the helical screw expander and operable on dry vapour as in the Rankine cycle.

8. Apparatus for utilizing thermal energy comprising means for pumping a first fluid through a low grade heat source, means for supplying the heat from the first fluid to a more volatile, second, fluid, means for recycling the first fluid to the low grade heat source, means for substantially adiabatically pressurizing the said second fluid, a helical screw expander capable of operating effectively with wet working fluid and of progressively drying said fluid during expansion, the expander being connected to receive the second fluid from the pressurizing means and serving substantially adiabatically to expand to an at least substantially dry state and hot pressurized second fluid by flashing, a turbine connected to receive the substantially the whole of the exhaust of the expander and a condenser connected to receive the substantially the whole of the second fluid exhausted from the turbine.

9. Apparatus for utilizing low grade thermal energy comprising pump means for passing a first fluid through a low grade heat source, means for passing the heat from the first fluid to a second, more volatile, fluid, a helical screw expander connected to receive the heated second fluid and expand it to a substantially dry state, a further, turbine, expander receiving substantially the whole of the exhaust substantially dry second fluid from the helical screw expander, and means for returning the first fluid to the low grade heat source.

* * * * *